US006036306A

United States Patent [19]

Haigo

[11] Patent Number: 6,036,306

[45] Date of Patent: Mar. 14, 2000

[54] INK CARTRIDGE

[75] Inventor: Hideaki Haigo, Nagoya, Japan

[73] Assignee: Brother Kogyo Kabushiki Kaisha, Nagoya, Japan

[21] Appl. No.: 09/039,412

[22] Filed: Mar. 16, 1998

[30] Foreign Application Priority Data

Mar. 19, 1997 [JP] Japan ..... 9-066342

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS 5,489,932 2/1996 Ceschin et al. ..... 347/87
5,821,965 10/1998 Oda et al. ..... 347/86

FOREIGN PATENT DOCUMENTS

A-6-238908 8/1994 Japan .

*Primary Examiner*—N. Le
*Assistant Examiner*—Michael Nghiem
*Attorney, Agent, or Firm*—Oliff & Berridge, PLC

[57] ABSTRACT

The position of the ink supply port 4*b* formed in the front wall 4*k* of the cartridge case 4, through which ink is supplied to the ink jet recording head 5, is determined to be higher than the position of the through hole 4*h* for connecting the ink storing chamber 4*e* and the accommodating chamber 4*g* accommodating the porous member 4*f*, thereby producing a height difference between the two positions. The ink flow passage R formed in the ink in the ink storing chamber 4*e* between the through hole 4*h* and the ink supply port 4*b* includes two curve parts R2 and R4. The air bubbles remaining in the ink flowing along the ink flow passage R are released from the ink at the curve parts R2 and R4 is respectively and gather into air bubbles B that are masses of small air bubbles, which are accumulated in the air accumulating space 14 formed at un upper portion of the ink storing chamber 4*e*.

6 Claims, 5 Drawing Sheets

INK CARTRIDGE

BACKGROUND OF THE INVENTION

1. Field of the Invention

The present invention relates to an ink cartridge comprising an accommodating chamber in which a porous member impregnated with ink is held, an ink supply port provided in a wall portion, which is to be connected with an outside head, and an ink storing chamber between the accommodating chamber and the wall portion, and more particularly to an ink cartridge in which an ink flow passage is formed in a curve from a through hole connecting the accommodating chamber and the ink storing chamber to the ink supply port so that air bubbles existing in the ink can be released from the ink, to stop the air bubbles from entering through the ink supply port into the outside head, thereby to prevent a deterioration in printing quality, and prevent the outside head from becoming unworkable.

2. Description of Related Art

An ink cartridge to be used in an ink jet printer holds a porous member impregnated with ink in an accommodating chamber in a cartridge case. The ink cartridge supplies ink through an ink supply port formed in a wall of the cartridge case to a recording head side in the outside ink jet printer and, simultaneously, introduces the atmospheric air into the accommodating chamber through an air communication port formed in another wall of the cartridge case, which is positioned away from the position of the ink supply port.

The air introduced through the air communication port replaces the ink impregnated in the porous member, causing the ink to be discharged little by little through the ink supply port, which achieves a smooth ink supply to the ink jet head.

When ink is poured to the porous member held in the cartridge case, it is general to suck the air out of the cartridge case and then pour ink through the ink supply port or the air communication port of the cartridge case into the porous member, absorbing the ink.

However, the inside of the cartridge case can not be made in a complete vacuum even if the air is sucked out of the cartridge case, which may cause a possibility that the air bubbles remaining in the porous member is left as it is in the poured ink. The air bubbles will stably exist in the ink in the porous member. There is a possibility that the air bubbles are sucked into the recording head during a printing operation although enough ink remains in the ink cartridge, deteriorating a printing quality or preventing a printing operation by the recording head.

To solve the above problems, there is known an ink cartridge wherein a liquid chamber (an ink storing chamber) is formed on an ink flow passage through which ink flows from a porous member to an ink supply port in order to prevent the air bubbles from entering through the ink supply port into a recording head side, which is disclosed, for example, in a Japanese Patent Application Laid-open No. 6-238908.

However, in such the ink cartridge, the ink flow passage is formed in a substantially straight form between the through hole which connects the accommodating chamber with the ink storing chamber and the ink supply port. The ink flow passage merely goes straight through the ink storing chamber, accordingly. In this case, the air bubbles remaining in the ink flow can not be effectively removed therefrom while the ink flows along the ink flow passage between the through hole and the ink supply port, thus allowing the air bubbles to enter into the recording head, resulting in a deterioration in printing quality and causing the unworkableness of the recording head.

SUMMARY OF THE INVENTION

The present invention has been made in view of the above circumstances and has an object to overcome the above problems and to provide an ink cartridge capable of removing the air bubbles remaining in the ink from the ink by forming an ink flow passage in a curve from a through hole for connecting an accommodating chamber and an ink storing chamber to an ink supply port, to stop the air bubbles from entering through the ink supply port into the outside head, thereby preventing a deterioration in printing quality and preventing the outside head from becoming unworkable.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink cartridge of this invention comprises an accommodating chamber for accommodating a porous member which is impregnated with ink, an ink storing chamber for storing ink, the ink storing chamber being provided adjacent to the accommodating chamber, a through hole for connecting the accommodating chamber and the ink storing chamber, the through hole being formed at a first position in a side of the ink storing chamber, and an ink supply port for supplying the ink from the ink storing chamber to an outside recording head, provided at a second position in another side of the ink storing chamber, where a positional displacement is produced with respect to the first position of the through hole, wherein an ink flow passage is formed in the ink storing chamber between the through hole and the ink supply port based on the positional displacement between the first position of the through hole and the second position of the ink supply port and includes at least a curve part.

In the ink cartridge according to the present invention, a positional displacement is established between the first position where the through hole is formed in a side of the ink storing chamber and the second position where the ink supply port is formed in another side of the ink storing chamber are displaced from each other. When the ink cartridge is connected with an ink jet recording head of an ink jet printer, therefore, the ink is allowed to flow along at least one curve part of the ink flow passage formed between the through hole to the ink supply port in the ink storing chamber.

In this way, the curve part is included in the ink flow passage formed in the ink storing chamber, so that the air bubbles remaining in the ink can be released from the ink at the curve part due to a difference in specific gravity between the ink and the air bubbles remaining therein while the ink flows along the ink flow passage, and the air bubbles gather. Accordingly, it is possible to completely stop the air bubbles from entering through the ink supply port into the ink jet recording head side even if the air bubbles remain in the ink, preventing a deterioration in printing quality and preventing the ink jet recording head from becoming unworkable.

The ink cartridge is preferably provided with an air accumulating space at an end portion in the ink storing chamber. It is more preferable that the air accumulating space is provided at the end portion in the ink storing chamber in a vertical direction with respect to the flow direction of the ink flowing in the through hole. In this case, small air bubbles remaining in the ink can be released from the ink when the ink flows along the curve part of the ink flow passage, then gathering into a lump, and effectively accumulating in the air accumulating space.

Preferably, the flow direction of the ink flowing in the ink storing chamber is changed by an angle of about 90° when the ink flows along the curve part. When the ink flow changes its direction by an angle of about 90°, it shows the remarkable properties of releasing and gathering air bubbles due to a difference in specific gravity between the ink and the air bubbles remaining in the ink. The air bubbles in the ink flowing in the curve part can be effectively removed from the ink and be gathered.

Furthermore, the positional displacement between the first position of the through hole and the second position of the ink supply port may be produced based on a height difference between the first and the second positions.

The ink cartridge is preferably provided with outer walls defining the accommodating chamber and an air communication port formed on an outer wall opposite to the ink storing chamber, among the outer walls, the air communication port serving for connecting the accommodating chamber to the atmosphere. It is preferable to provide an air buffer portion having a winding passage between the air communication port and the accommodating chamber.

The above and further objects and novel features of the invention will more fully appear from the following detained description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention.

In the drawings.

DETAILED DESCRIPTION OF THE PREFERRED EMBODIMENT

A detailed description of preferred embodiments of an ink cartridge embodying the present invention will now be given referring to the accompanying drawings.

An ink cartridge in the first embodiment will be explained hereinafter with reference to FIGS. 1 to 3

An ink cartridge 2 is provided with a cartridge case 4 formed in a rectangular parallelopiped shape having an upper opening 4*a* and a cover member 6 which covers the opening 4*a*. This ink cartridge 2 is to be used in an ink jet printer for performing printing by ejecting ink onto a recording medium (printing paper sheet), where it is connected with an ink jet recording head 5 to supply ink to the ink jet recording head 5, which will be mentioned later.

Figure 1:
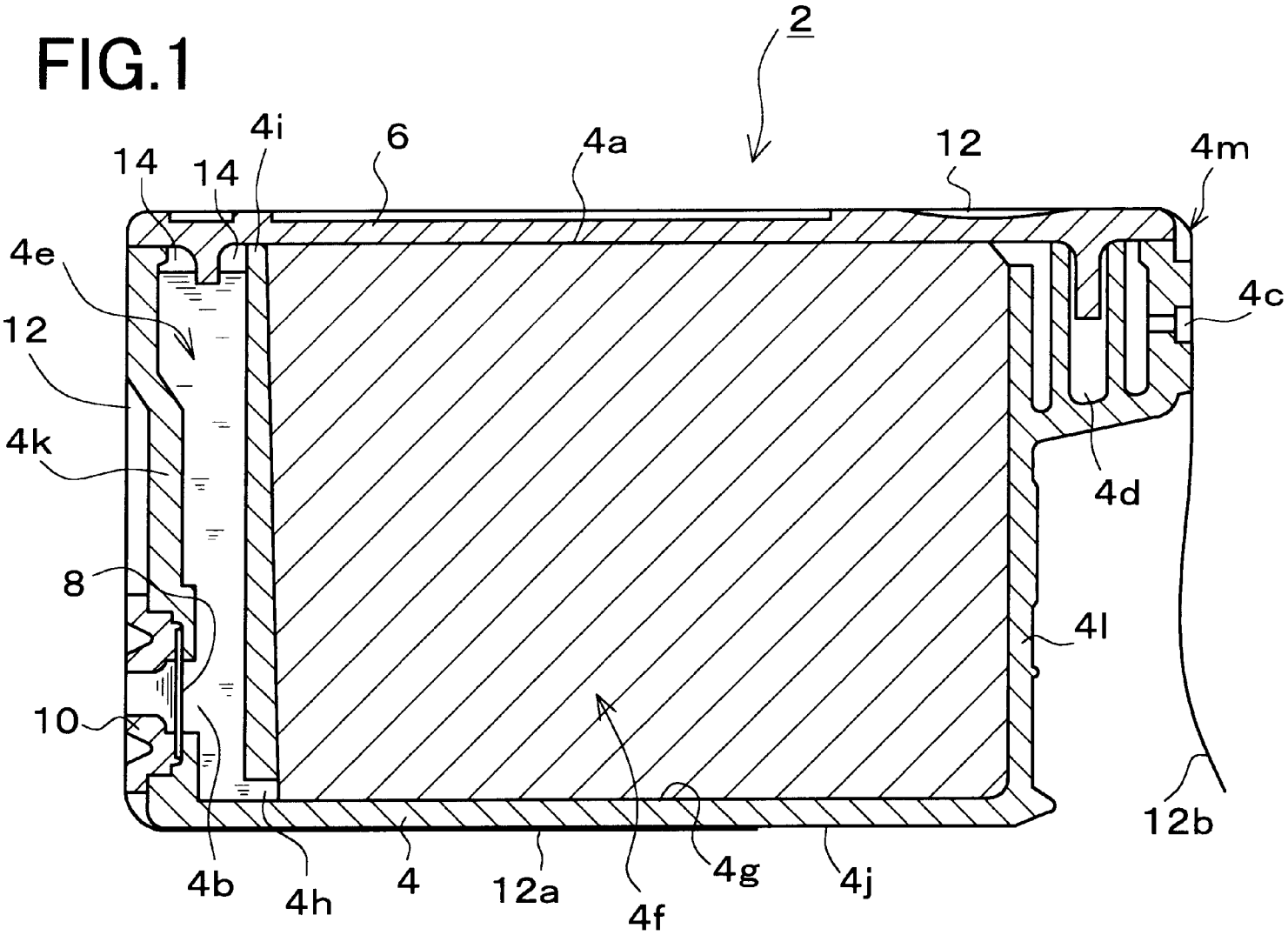
FIG. 1 is a schematic longitudinal sectional view of an ink cartridge in a first embodiment according to the present invention.

The rectangular parallelopiped cartridge case 4 is constructed of a rectangular bottom wall 4*j*, a front wall 4*k* provided vertically at the front (a left side in FIG. 1) of the bottom wall 4*j*, a back wall 41 provided vertically at the back (a right side in FIG. 1) of the bottom wall 4*j*, a dividing wall 4*i* provided slightly apart from the front wall 4*k*, and a pair of side walls provided vertically at both sides of the bottom wall 4*j* (i.e., at both sides of the bottom wall 4*j* in a vertical direction with respect to the drawing paper of FIG. 1).

At a lower side of the front wall 4*k* is formed an ink supply port 4*b* which serves for supplying ink to an ink supply manifold 5*a* of an ink jet recording head 5 when the ink cartridge 2 is installed in the ink jet printer. In the ink supply port 4*b*, provided are a mesh filter member 8 for removing dust or dirt included in the ink to be supplied to the ink jet recording head 5 and an adaptor 10 which connects the ink cartridge 2 with the recording head 5.

The space defined by the front wall 4*k* and the dividing wall 4*i* forms an ink storing chamber 4*e* for temporarily storing ink. The space defined by the dividing wall 4*i* and the cap 6 at an upper portion of the ink storing chamber 4*e* forms an air accumulating space 14 for accumulating air bubbles released from the ink in the ink storing chamber 4*e* as mentioned later.

The space defined by the dividing wall 4*i* and the back wall 41 at a back portion of the ink storing chamber 4*e* forms an accommodating chamber 4*g* in which a porous member 4*f* (which is made of, for example, polyurethane resin foam) capable of absorbing or sucking ink is accommodated. The accommodating chamber 4*g* and the ink storing chamber 4*e* are connected with each other through a through hole 4*h* formed at a lower portion of the dividing wall 4*i*. As shown in FIGS. 1 and 2, there is set a difference in height between the ink supply port 4*b* formed in the front wall 4*k* and the through hole 4*h* formed in the dividing wall 4*i*. Specifically, the ink supply port 4*b* is disposed higher than the through hole 4*h*. Based on the height difference between the ink supply port 4*b* and the through hole 4*h*, the ink flow passage in the ink storing chamber 4*e* is formed in a curve from the through hole 4*h* to the ink supply port 4*b*, where air bubbles remaining in the ink are released therefrom.

The back wall 41 is provided at an upper portion thereof with a projection portion 4*m* formed protruding outward. The projection portion 4*m* is provided with an air communication port 4*c* for connecting the accommodating chamber 4*g* to the atmosphere and, inside thereof, with a winding passage and an air butter portion 4*d* for connecting the air communication port 4*c* with the accommodating chamber 4*g*. The air buffer portion 4*d* serves for preventing the evaporation of the ink impregnated in the porous member 4*f* through the air communication port 4*c*.

Next, a process to produce the above ink cartridge 2 is explained with reference to FIGS. 3(*a*) and 3(*b*). As shown in FIGS. 3(*a*) and 3(*b*), firsts the porous member 4*f* in a compressed state is inserted from the opening 4*a* into the accommodating chamber 4*g* of the cartridge case 4. The cap 6 is then ultrasonic-welded an the cartridge case 4. The ink deaerated is supplied through the ink supply port 4*b* into the ink chamber 4*e* by use of an ink pouring device not shown. Note that FIG. 3(*a*) is a longitudinal sectional view taken along the line A—A in FIG. 3(*b*).

The ink pouring process with respect to the cartridge case 4 is made as follows.

First, the ink pouring device not shown is connected with the ink supply port 4*b*. Prior to ink pouring, a suction device, for example, a vacuum pump, etc., is connected to the air communication port 4*c* to suck air from the cartridge case 4, thereby making the inside of the cartridge case 4 in a negative pressure state.

When the negative pressure of the inside of the cartridge case 4 become a predetermined negative value (for example, about 50 mmHg in the case of defining one atmospheric pressure as 760 mmhg), the ink pouring device is caused to start pouring ink.

The ink being poured by the ink pouring device is easily sucked into the inside of the cartridge case 4 due to the negative pressure therein. At this time, the ink poured through the ink supply port 4*b* collides with the dividing wall 4*i* which partitions the inside of the cartridge case 4 into the accommodating chamber 4*g* and the ink storing chamber 4*e*, thus flowing upward and downward, when the ink substantially flows toward the lower portion of the ink chamber 4*e* where a flow-resistance is low, to fill the ink chamber 4*e*. Then, the ink flows through the through hole 4*h* provided at a lower portion of the dividing wall 4*i* into the accommodating chamber 4*g*, and permeates the porous member 4*f* inside the accommodating chamber 4*g*. The porous member 4*f* is thus impregnated with the ink.

After the porous member 4*f* disposed in the cartridge case 4 is impregnated with ink, as shown in FIG. 1, a long sealing material 12 is heat-welded over the bottom wall 4*j*, the front wall 4, an upper surface of the cap 6, and an outer surface of the projection portion 4*m* to firmly seal the ink supply port 4*b* and the air communication port 4*c*. Accordingly, the ink supply port 4*b* and the air communication port 4*c* are completely sealed. The producing process of the ink cartridge 2 is completed.

It is to be noted that an end portion 12*a* of the sealing material 12 positioned at the ink supply port 4*b* side is heat-welded on a bottom surface 4*j* of the cartridge case 4, while another end portion 12*b* positioned at the air communication port 4*c* side is not heat-welded. This is because it allows an user to easily remove the sealing material 12 from the end portion 12*b* positioned at the air communication port 4*c* side, to open the ink supply port 4*b* and the air communication port 4*c* to use the ink cartridge 2.

Figure 2:
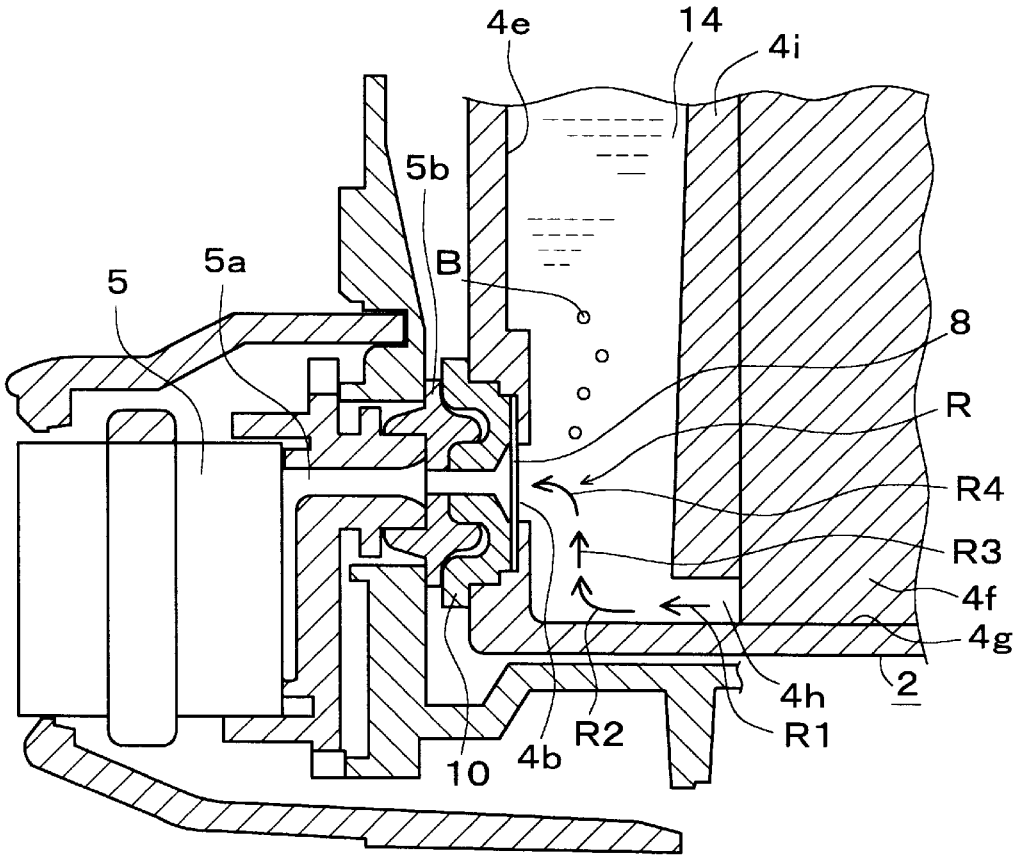
FIG. 2 is an enlarged partial view of the ink cartridge in use in the first embodiment, specifically showing an ink flow passage formed in an ink storing chamber.
Figure 3A:
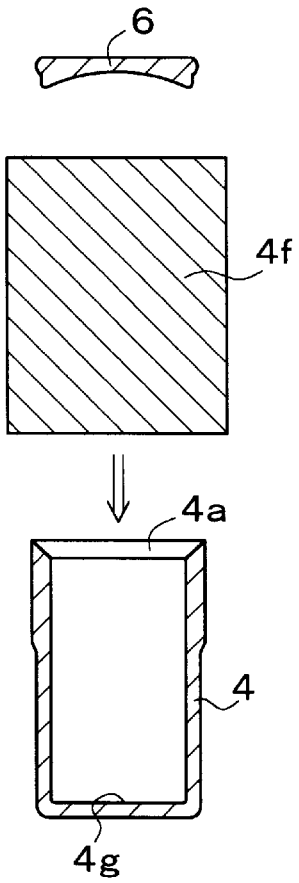
FIGS. 3(*a*) and (*b*) are schematic explanatory views showing a process to produce the ink cartridge.
Figure 3B:
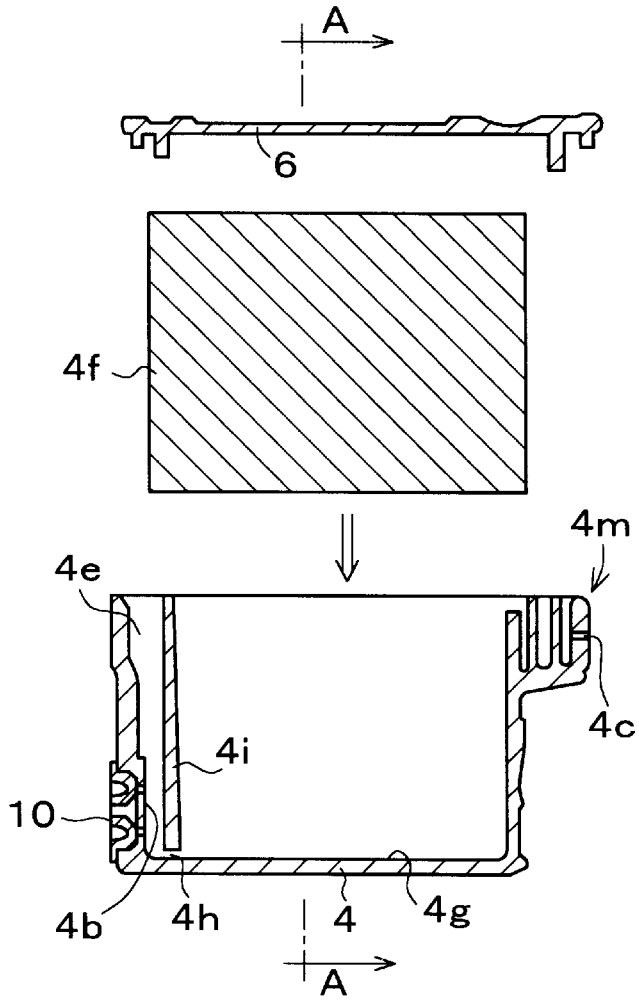

When the ink cartridge 2 constructed as above is actually used, after the sealing material 12*a* is removed therefrom to open the air communication port 4*c* and the ink supply port 4*b*, the adaptor 10 disposed at an outside of the ink supply port 4*b* is jointed to the adaptor 5*b* of the ink jet recording head 5 side as shown in FIG. 2. When the suction operation is then performed from the recording head 5 side, the ink impregnated in the porous member 4*f* in the accommodating chamber 4*g* is sucked to flow along an ink flow passage R indicated by an arrow in FIG. 2 from the accommodating chamber 4*g*, passing through the through hole 4*h*, the ink chamber 4*e*, and the ink supply port 4*b*, into the manifold 5*a* of the recording head 5.

The ink flow passage R indicated by the arrow in FIG. 2 is provided in the ink stored in the ink storing chamber 4*e*. The ink flow passage R mainly includes a straight part R1 in the through hole 4*h*, a curve part R2 going toward the ink chamber 4*e* (in a vertical direction in FIG. 2), a straight part R3 along the ink chamber 4*e*, and a curve part R4 toward the ink supply port 4*b*.

When the ink flows through the curve parts R2 and R4 of the ink flow passage, where the direction of the ink flow is changed by an angle of about 90°, the air bubbles in the ink will gather due to a difference in specific gravity between the ink and the air bubbles remaining in the ink. This property is dependent on a curved form of the curve parts R2 and R4 and becomes remarkable in the case of the ink flow changing its direction by an angle of about 90°. Air bubbles B, each of which is formed of lumped small air bubbles, are released from the ink flow and rise upward in the ink in the ink storing chamber 4*e*. The air bubbles B are accumulated in the air accumulating space 14 formed in the upper portion of the ink storing chamber 4*e* as shown in FIG. 1.

As mentioned above, in the ink cartridge 2 in the first embodiment, the position where the ink supply port 4*b* is formed in the front wall 4*k* of the cartridge case 4, through which ink is to be supplied to the ink jet recording head 5, is determined higher than the position where the through hole 4*h* which connects the accommodating chamber 4*g* in which the porous member 4*f* is held with the ink storing chamber 4*e*, producing a difference in height between the position of the ink supply port 4*b* and that of the through hole 4*h*. Also, two curve parts R2 and R4 are included in the ink flow passage R formed in the ink in the ink storing chamber 4*e* between the through hole 4*h* and the ink supply port 4*b*, so that air bubbles remaining in the ink can be released from the ink flowing along the ink flow passage R at each curve part R2 or R4 and then gather. The air bubbles B each constructed of lumped small air bubbles are accumulated in the air accumulating space 14 to be formed at an upper portion of the ink storing chamber 4*e*. Accordingly, the air bubbles remaining in the ink can completely be prevented from entering through the ink supply port 4*b* into the ink jet recording head 5 side, thus preventing a deterioration in printing quality. The ink jet recording head 5 can also be prevented from becoming unworkable.

Next, the second embodiment of the ink cartridge according to the present invention will be described with reference to FIGS. 4 and 5. The ink cartridge in the second embodiment has substantially the same construction as the ink cartridge in the first embodiment, except that, in the ink cartridge in use in the second embodiment, the ink supply port is provided so as to open downward, through which the ink cartridge is connected with the ink jet recording head.

Figure 4:
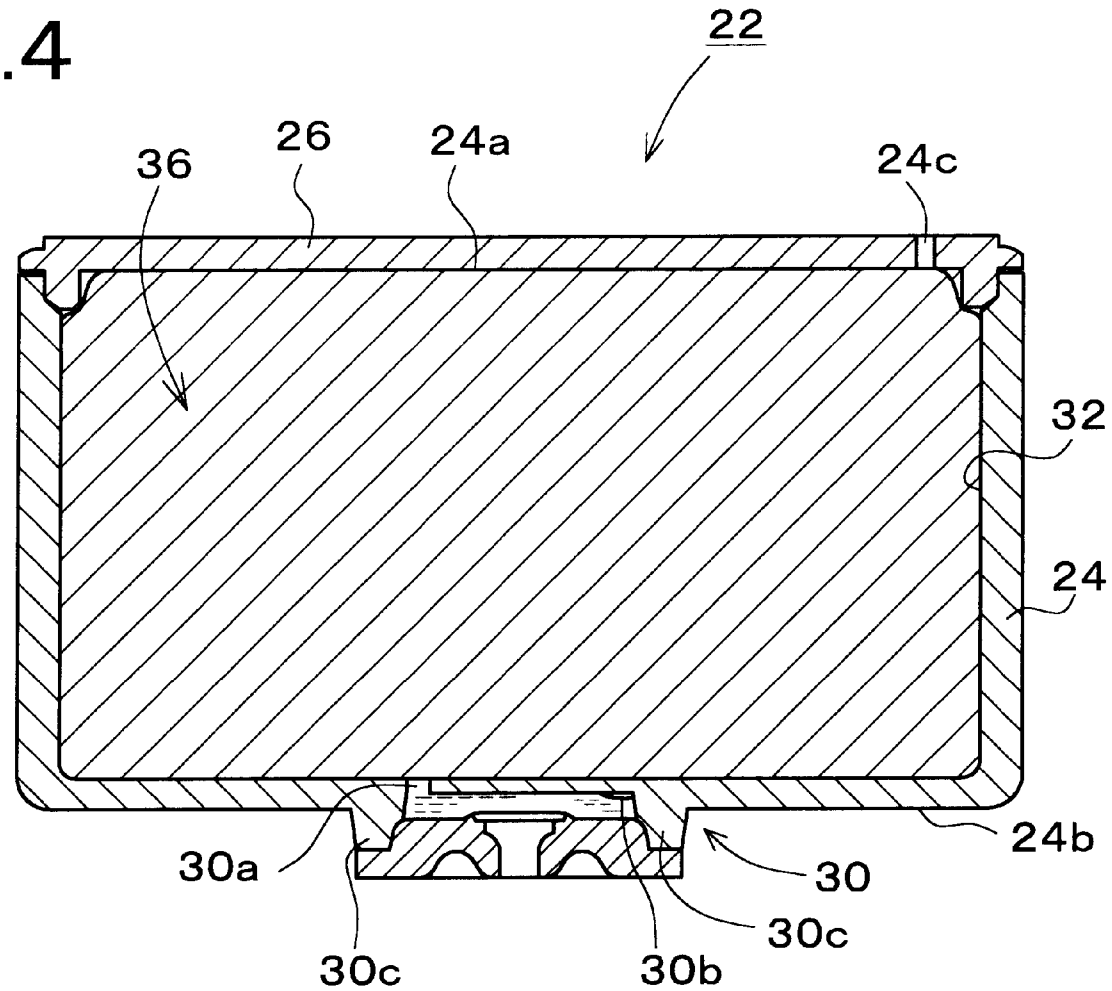
FIG. 4 is a schematic longitudinal sectional view of an ink cartridge in a second embodiment according to the present invention.
Figure 5A:
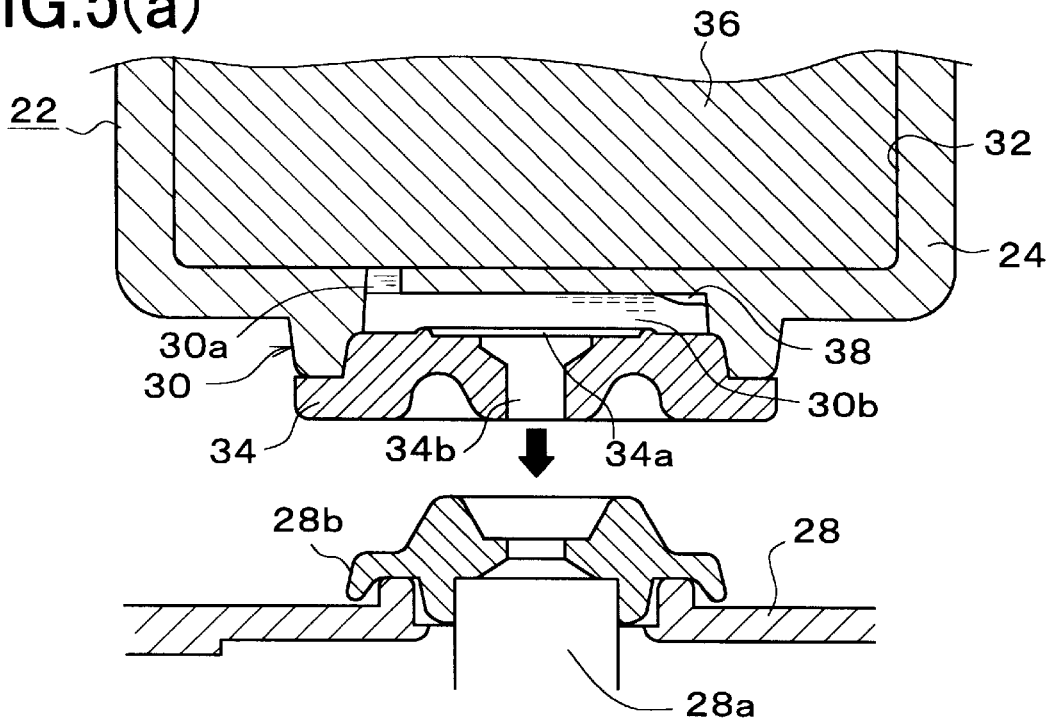
FIGS. 5(*a*) and (*b*) are enlarged partial views of the ink cartridge in the second embodiment, specifically showing an ink flow passage formed in an ink storing chamber.
Figure 5B:
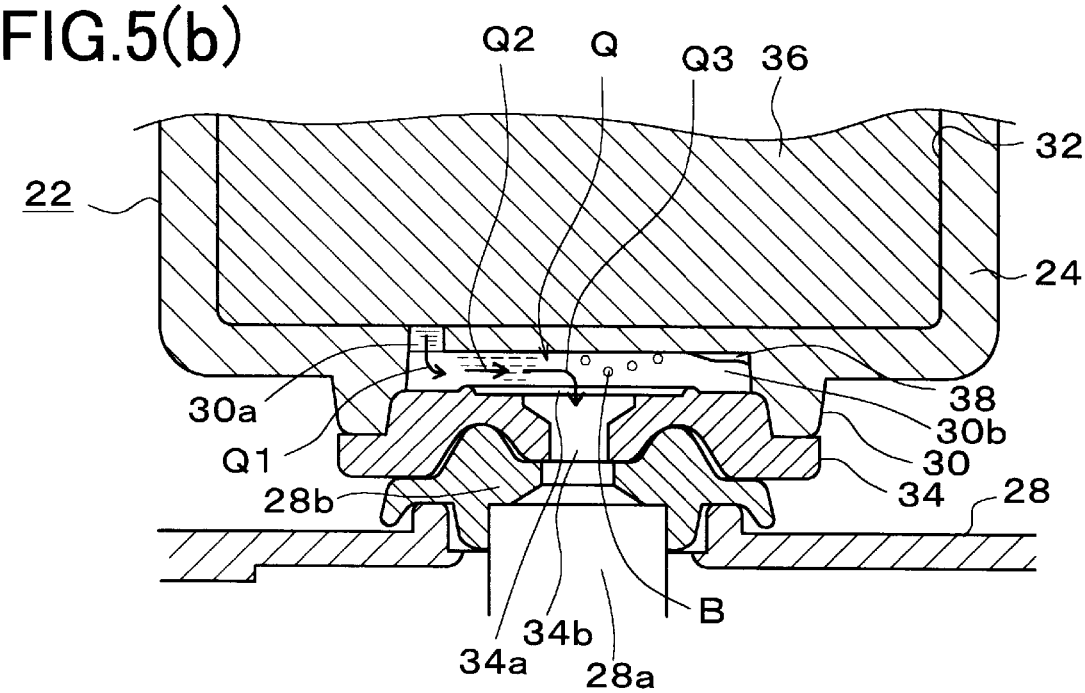

The ink cartridge 22, in FIGS. 4 and 5, is provided with a cartridge case 24 formed in a rectangular parallelopiped shape having an upper opening 24*a* and a cover member 26 which covers the opening 24*a*. This ink cartridge 22 is to be used in an ink jet printer for performing printing by ejecting ink onto a recording medium (printing paper sheet), when it is connected with an ink jet recording head 28 to supply ink thereto. The cartridge case 24 has the same structure as the cartridge case 4 in the first embodiment. In the cap 26 covering the opening 24*a* of the cartridge case 24, formed is an air communication port 24*c* for introducing atmospheric air into the accommodating chamber 32 in which a porous member 32 is held below the cap 26.

An ink supply portion 30 is provided on a bottom wall 24*b* of the cartridge case 24. The ink supply portion 30, as shown in FIGS. 5(*a*) and 5(*b*), is connected with an ink jet recording head 28 when the ink cartridge 22 is set in the ink jet printer, to supply the ink from the accommodating chamber 32 to a manifold 28A of the recording head 28.

The ink supply portion 30 is provided with a projecting wall 30*c* cylindrically formed and a through hole 30*a* in the bottom wall 24*b*, close to the projecting wall 30*c*, through which the ink is discharged from the accommodating chamber 32. On the projecting wall 30*c* is attached an adaptor 34 for connecting the ink cartridge 22 with the recording head 28. The space formed between the adaptor 34 and the bottom wall 24*b* opposite thereto forms an ink storing chamber 30*b* for temporarily storing ink therein. In the ink storing chamber 30*b*, a space is produced at an opposite end side with respect to the through hole 30*a*, which serves as an air accumulating space 38 where air bubbles released from the ink in the ink storing chamber 30*b* are accumulated as mentioned later.

The adaptor 34 is provided with a mesh filter member 34*a* for removing dust or dirt included in the ink to be supplied to the recording head 28 and an ink supply port 34*b* through which the ink is supplied to the manifold 28*a* of the recording head 28. As clearly from FIGS. 5(*a*) and (*b*), when the adaptor 34 is attached to the projecting wall 30*c*, a height difference is produced between the position of the through hole 30*a* and the position of the ink supply port 34*b*. Specifically, the through hole 30*a* is provided at a position higher than the ink supply port 34*b*. The through hole 30*a* and the ink supply port 34*b* are displaced from each other in a horizontal direction. More specifically, the through hole 30*a* and the ink supply port 34*b* are arranged away from each other by a distance corresponding to about a radius of the adaptor 34.

The space defined by the cartridge case 24 and the cap 26 forms an accommodating chamber 32 in which a porous member 36 (which is made of urethane foam resin in the embodiment) is held.

It is noted that an adaptor 28*b* is disposed on an outside of the ink manifold 28*a* of the ink jet recording head 28. The adaptor 28*b* is to be tightly connected with the adaptor 34 provided in the ink cartridge 22.

The ink cartridge 22 constructed as above is connected with the ink jet recording head 28, as shown in FIG. 5(*a*), by making the adaptor 34 in the ink cartridge 22 side come into close contact with the adaptor 28*b* in the recording head 28 side and firmly attach them to each other as shown in FIG. 5(*b*).

Thereafter, during a printing operation by the ink jet recording head 28 to print characters and the like on a recording medium, when the suction operation is made from the recording head 28 side, the ink impregnated in the porous member 36 is sucked toward the through hole 30*a* formed in the bottom wall 24*b* of the accommodating chamber 32, which corresponds to the projecting wall 30*c* of the ink supply portion 30. The ink then flows along an ink flow passage Q indicated by an arrow in FIG. 5(*b*), into the ink storing chamber 30*b*, and then changes its flowing direction toward the ink supply port 34*b*, and finally flows through a joint portion between the adapters 34 and 28*b* into the manifold 28*a*.

The ink flow passage Q indicated by the arrow in FIG. 5(*b*) is formed in the ink stored in the ink storing chamber 30*b*. This ink flow passage Q mainly includes a curve part Q1 going from the through hole 30*a* toward the ink chamber 30*b*, a straight part Q2 along the ink chamber 30*b*, and a curve part Q3 toward the ink supply port 34*b*.

When the ink flows along the curve parts Q1 and Q3 of the ink flow passage Q, which change the flow direction by an angle of about 90°, the air bubbles in the ink will gather due to a difference in specific gravity between the ink and the air bubbles remaining in the ink. This property is dependent on a curved form of the curve parts Q1 and Q3, and becomes remarkable in the case of the ink flow changing its direction by an angle of about 90°. The air bubbles B each constructed of lumped small air bubbles are released from the ink flow and move rightward in FIG. 5(*b*) in the ink storing chamber 30*b*. The air bubbles B are accumulated in the air accumulating space 38 formed in the right upper portion of the ink storing chamber 30*b* as shown in FIG. 5(*b*).

As mentioned above, in the ink cartridge 22 in the second embodiment, the position of the through hole 30*a* formed in the bottom wall 24*b* of the cartridge case 24 to supply ink to the ink jet recording head 28 is determined higher than the position of the ink supply port 34*b* formed in the adaptor 34 to be attached to the projecting wall 30*c* of the ink supply portion 30, producing a height difference between the arrangement positions.

Also, two curve parts Q1 and Q3 are included in the ink flow passage Q formed in the ink in the ink storing chamber 30*b* between the through hole 30*a* and the ink supply port 34*b*, so that air bubbles remaining in the ink can be released from the ink flowing along the ink flow passage Q at each curve part Q1 or Q3 and then gather. The air bubbles B of lumped small air bubbles are accumulated in the air accumulating space 38 formed at a right portion in the ink storing chamber 30*b*. Accordingly, the air bubbles remaining in the ink can completely be prevented from entering though the ink supply port 34*b* into the ink jet recording head 28 side, thus preventing a deterioration in printing quality. The ink jet recording head 28 can also be prevented from becoming unworkable.

While the invention has been particularly shown and described with reference to preferred embodiments thereof, it will be understood by those skilled in the art that the foregoing and other changes in form and details can be made therein without departing from the spirit and scope of the invention.

For instance, in the first and second embodiments, the ink cartridges 2 and 22 may be positioned at a slant so that the ink supply ports 4*b* and 34*b* are inclined, through which the ink is discharged obliquely downward from the ink chambers 4*e* and 30*b*. In this case, they are preferably disposed so that the through holes 4*h* and 30*a* are positioned at lower positions than the ink supply ports 4*b* and 34*b* respectively, which can provide a superior effect of removing air bubbles from the ink.

In the ink cartridge 2 in the first embodiment, the ink flow passage R formed in the ink storing chamber 4*e* is constructed to have two curve parts R2 and R4. It is also possible to obtain the effect of releasing air bubbles from the ink and gathering them if the ink flow passage R includes at least one curve part.

Furthermore, in the ink cartridge 2 in the first embodiment, the position of the ink supply port 4*b* is set to be higher than the position of the through hole 4*h* to form the ink flow passage R. The present invention is not limited thereto. Since the ink flow passage including a curve part can be formed if there is a difference in height between the ink supply port 4*b* and the through hole 4*h*, the same effect can be obtained even when the height relation between the positions of the ink supply port 4*b* and the through hole 4*h* is reverse.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink cartridge for supplying ink to an outside recording head, the ink cartridge comprising:

an accommodating chamber for accommodating a porous member which is impregnated with ink;

an ink storing chamber for storing ink, the ink storing chamber being provided adjacent to the accommodating chamber;

a partition wall with a lower end, the partition wall dividing the accommodating chamber and the ink storing chamber;

a through hole for connecting the accommodating chamber and the ink storing chamber, the through hole being formed at a first position in a side of the ink storing chamber, the first position being defined by the lower end of the partition wall and a bottom wall of the accommodating chamber; and an ink supply port for supplying the ink from the ink storing chamber to the outside recording head, provided at a second position higher than the first position in another side of the ink storing chamber, where a positional displacement is produced between the first position and the second position based on a difference in height therebetween, so that the through hole and the ink supply port do not overlap with each other;

wherein an ink flow passage is formed in the ink storing chamber between the through hole and the ink supply port based on the positional displacement between the first position of the through hole and the second position of the ink supply port and the ink flow passage includes at least a curve part.

2. An ink cartridge according to claim 1, wherein an air accumulating space is formed at an upper end portion of the ink storing chamber.

3. An ink cartridge according to claim 2, wherein, the upper end portion is positioned in a substantial vertical direction against an ink flow direction when ink flows along a horizontal direction via the through hole.

4. An ink cartridge according to claim 2, wherein the ink flow direction is changed by an angle of approximately 90° while the ink flows along the curve part of the ink flow passage.

5. An ink cartridge according to claim 2, further comprising:

a plurality of outer walls forming the accommodating chamber; and an air communication port for connecting the accommodating chamber to atmosphere, provided on one of the outer walls positioned opposite to the ink storing chamber.

6. An ink cartridge according to claim 5, further comprising an air buffer portion between the air communication port and the accommodating chamber.

* * * * *